United States Patent [19]

Beyl

[11] 4,098,522

[45] Jul. 4, 1978

[54] SAFETY SKI BINDING

[76] Inventor: Jean Joseph Alfred Beyl, Boulevard Victor-Hugo, Nevers, Niévre, France

[21] Appl. No.: 651,570

[22] Filed: Jan. 22, 1976

[30] Foreign Application Priority Data

Jan. 28, 1975 [FR] France ..... 75 02536
May 23, 1975 [FR] France ..... 75 16101

[51] Int. Cl.[2] ..... A63C 9/08

[52] U.S. Cl. ..... 280/618; 280/623; 280/11.37 E

[58] Field of Search ..... 280/618, 617, 616, 628, 280/623, 613, 611, 636, 11.37 E

[56] References Cited

U.S. PATENT DOCUMENTS

| | | | |
|---|---|---|---|
| 3,284,091 | 11/1966 | Spier | 280/11.37 E X |
| 3,410,568 | 11/1968 | Wiley | 280/618 |
| 3,727,932 | 4/1973 | Druss et al. | 280/613 |
| 3,838,866 | 10/1974 | D'Alessio et al. | 280/618 |
| 3,866,928 | 2/1975 | Gertsch et al. | 280/618 |
| 3,900,205 | 8/1975 | Sittmann | 280/618 |
| 3,907,313 | 9/1975 | Salomon | 280/618 |
| 3,942,809 | 3/1976 | Sittmann | 280/618 X |

*Primary Examiner*—Joseph F. Peters, Jr.
*Assistant Examiner*—Milton L. Smith
*Attorney, Agent, or Firm*—Bierman & Bierman

[57] ABSTRACT

A safety ski binding comprising a movable elongated plate pivotally and releasably mounted on the ski for supporting the ski boot. It has front and rear end means for holding the ski boot on the plate, resilient retaining means registering with one end of said plate and adapted to keep same in its normal position, and a fixed abutment member at the opposite end of said plate for retaining same on the ski. Said abutment member has curved and cooperating inclined faces that cooperate with a correspondingly curved registering end of said plate to cause self-centering of the plate.

4 Claims, 8 Drawing Figures

SAFETY SKI BINDING

BACKGROUND OF THE INVENTION

1. FIELD OF THE INVENTION

The present invention relates to safety ski bindings of the type comprising a movable plate adapted to support the corresponding ski boot and mounted for rotatable and longitudinal movement in a plane parallel to the ski and also detachable therefrom.

2. DESCRIPTION OF THE PRIOR ART

A movable plate comprises at its toe and heel ends attachment means for holding the ski boot in position thereon. Further, this movable plate is retained on the ski by devices cooperating with the toe and heel ends of the plate, respectively. One of said devices comprises a movable lock bolt associated with resilient means capable, in case of abnormal efforts, of releasing the plate from the ski.

The retaining device provided at the opposite end of the movable plate consists of a fixed member comprising a cavity adapted to receive the corresponding end of the movable plate or an anchoring lug carried by this plate. In fact, the only function of this last-mentioned device consists in holding the corresponding end of the movable plate in position while permitting the escape thereof when abnormally high efforts are exerted thereon.

In actual service conditions, the use of safety ski bindings of this character is attended by a delicate problem when resetting the movable plate to its operative position after it has been detached from the ski. Afer detachment since the skier's boot remains secured to the movable plate, the skier must present the assembly in a proper position from above the ski to reset successively one and then the other end of the plate to the toe and heel end retaining devices. Now, in most types of existing ski bindings this resetting operation can only be accomplished if the movable plate is presented in a well-defined, accurate position. But since this operation usually must be performed on a ski slope serious difficulties are experienced and in many cases, the skier must make several attempts before he succeeds in making the proper alignment. Moreover the difficulty of the problems to be solved increases considerably on freshly fallen, untaped snow.

SUMMARY OF THE INVENTION

It is therefore the essential object of the present invention to provide a safety ski binding of the type broadly set forth hereinabove which is designed with a view toward facilitating the resetting of the movable plate on the ski under any possible field circumstances.

More particularly, this ski binding is of the type wherein the movable plate comprises an aperture in its central portion adapted to be engaged on a fixed pivot member projecting above the ski surface. The plate is held at its ends by a first retaining device consisting of a simple abutment member and by a second retaining device comprising a resilient locking mechanism.

However, the present invention is characterized essentially in that said fixed abutment member comprises, on its side registering with said movable plate, a pair of faces inclined on either side of a common horizontal edge, the upper face being inclined upwardly in a direction away from said plate, and the lower face being inclined downwardly in the same direction. The faces as an engagement surface and as a retaining surface, respectively, to the corresponding end of the movable plate. They co-act with one or a plurality of complementary faces formed on the adjacent plate end. The plate itself is constantly urged to engage with said fixed abutment member by the resilient mechanism of the second retaining device.

With this arrangement, the movable plate can easily be reset on the ski by engaging firstly the corresponding end with the resilient locking mechanism of the second retaining device and engaging the edge of its opposite end on the inclined engagement face provided on the upper portion of said fixed abutment member. Then it is necessary only to depress this end of the movable plate to cause the latter to properly engage with this abutment member. The inclination of the engagement face, imparts a slight longitudinal movement to the movable plate against the force of the resilient locking mechanism of the second retaining device, until the the end of the movable plate passes the edge separating the upper engagement face from the lower retaining counter backing-off face of the fixed abutment member. Then, the resilient locking mechanism of the second retaining device will push the movable plate in the other direction and cause the other end of the plate to be pressed against the retaining face of the fixed abutment member.

According to another essential feature characterizing the present safety ski binding, the retaining face and the engagement face of said fixed abutment member have a concave curvature of substantially cylindrical profile, and the bearing face of the corresponding end of the movable plate has a convexity of corresponding cylindrical profile. The radius of curvature of these co-acting faces is inferior to the length of the movable plate and at least as long as the difference between the front end of this plate and the pivot member rigid with the ski.

It will become clearly apparent from the following disclosure that due to this specific feature, the movable plate is self-centered even if its longitudinal axis is not presented in strict alignment with the longitudinal center line of the ski, when resetting the plate on the ski.

However, other features and advantages of this invention will appear as the following description proceeds with reference to the attached drawings.

DETAILED DESCRIPTION OF THE INVENTION

Figure 2:
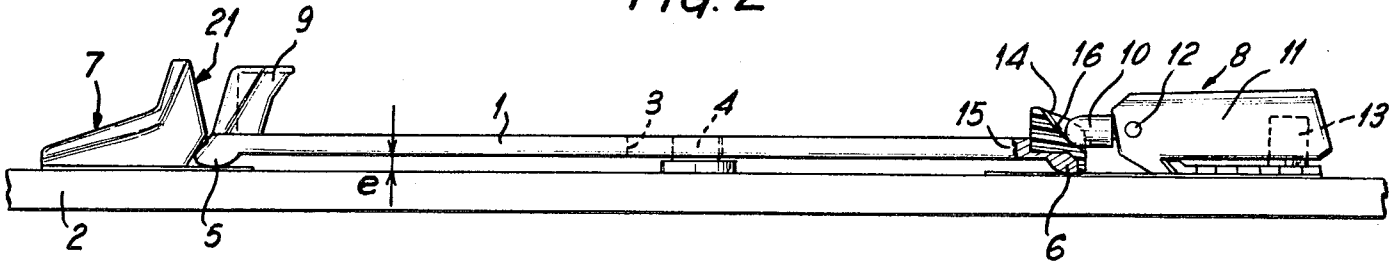
FIG. 2 is a side elevational view of the device with parts broken away.

The exemplary form of embodiment of the invention illustrated diagrammatically in the attached drawings comprises an elongated plate 1 detachable from the ski 2. At an intermediate location along its length this plate comprises an aperture 3 engageable on a fixed pivot member 4 secured to, and projecting from the top surface of, the ski 2. Preferably, pivot member 4 is disposed substantially in line with the skier's tibia. With this arrangement, the plate 2 can pivot on the ski about said fixed pivot member 4 in a plane parallel to the top surface of the ski. It may also escape completely from the ski by simply lifting its toe or heel end in relation thereto, or through any other movement in a direction away from the ski.

It should be emphasized that the aforesaid aperture 3 has an elongated configuration with its major axis coplanar with the center line of the ski, whereby the plate 1 can move with a certain liberty in this direction when the plate 1 is placed upon the ski with the fixed pivot member 4 engaging said aperture 3. Here, the plate 1 bears on the ski by means of a pair of transverse curved ribs 5, 6 formed under the plate's toe end and heel end, respectively. Thus, a free gap *e* is left between the top surface of the ski and the bottom of said plate 1, throughout the length of this plate.

The plate 1 is normally held down on the ski by means of a pair of retaining devices disposed at the front or toe end and at the rear or heel end thereof. These devices are designated in general by the reference numerals 7 and 8, respectively. On the other hand, the toe and heel ends of the movable plate 1 are provided with boot hold-down means. Thus, a jaw 9 adapted to hold down the toe end of the boot may be provided. Further the plate 1 will comprise at its heel end, a heel hold-down device of known and suitable type, which is no part of this invention and has therefore been omitted from the present specification and also from the drawings.

The heel retaining device 8 incorporates a resilient or spring-urged locking member adapted to hold in position the heel end of the movable plate 1 on the ski while permitting the release of said heel end when abnormal efforts are exerted thereon. This particular locking member comprises a lock bolt or finger 10 which, in its normal or operative position, extends longitudinally and projects from the front of a case 11 enclosing a spring-loaded mechanism associated with, and acting upon, said lock bolt 10.

This heel retaining device is so designed that the lock bolt 10 can pivot both upwardly about a horizontal pivot pin 12 disposed across the ski and horizontally about an upstanding vertical pivot member 13 (not shown) projecting at right angles from the ski surface. This last-mentioned possibility of pivotal movement of case 11 may be obtained by rotatably mounting the latter about said last-mentioned pivot member 13. Besides, this device may advantageously consist of the heel retaining device disclosed in a copending U.S. patent application Ser. No. 650,745 filed Jan. 20, 1976 entitled "Safety Ski Binding," to which reference may be made for the purposes of the present application.

Figure 1:
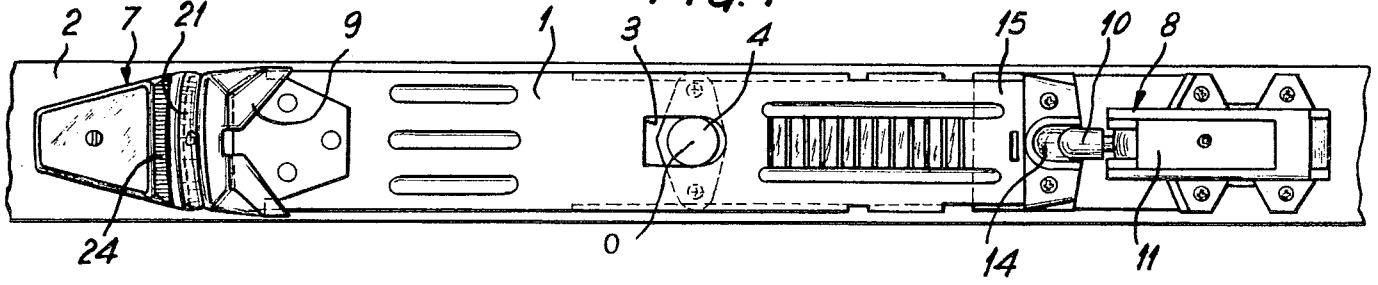
FIG. 1 is a plan view from above of the safety ski binding according to the invention.

The resilient mechanism incorporated by this device constantly urges the lock bolt 10 to the position illustrated in FIGS. 1 and 2. As shown, the front end of this lock bolt 10 engages a slideway 14 formed in the rear end 15 of plate 1. This slideway 14 consists of a groove opening upwards and extending in the longitudinal direction of the ski, the front end of the lock bolt 10 engaging the side walls of said groove. This front end also engages the bottom 16 of said groove. Now, according to an important feature of the present invention this bottom 16 is inclined upwardly and forwardly, as illustrated in FIG. 2. As will be explained presently, this groove arrangement enables the lock bolt 10 to exert a forward thrust against the rear end of the movable plate 1 when the latter has not properly and definitively assumed its locked or operative position.

The toe-end retaining device 7 consists of an abutment member secured to the top surface of the ski. At its lower portion, the rear side of the abutment member comprises a retaining face 17 characterized by a counter backing-off inclination, i.e. downwardly and forwardly from top to bottom. This face 17 extends across the ski and is adapted to retain in position the toe end of the movable plate 1 comprising in turn an inclined face 18 substantially parallel to said retaining face 17. Preferably, a resilient push-member, such as a spring-loaded ball 19, is provided centrally of said retaining face 17, and the bearing face 18 of plate 1 has formed in its center a cavity 20 adapted to receive said spring-loaded ball or like member 19.

Figure 3:
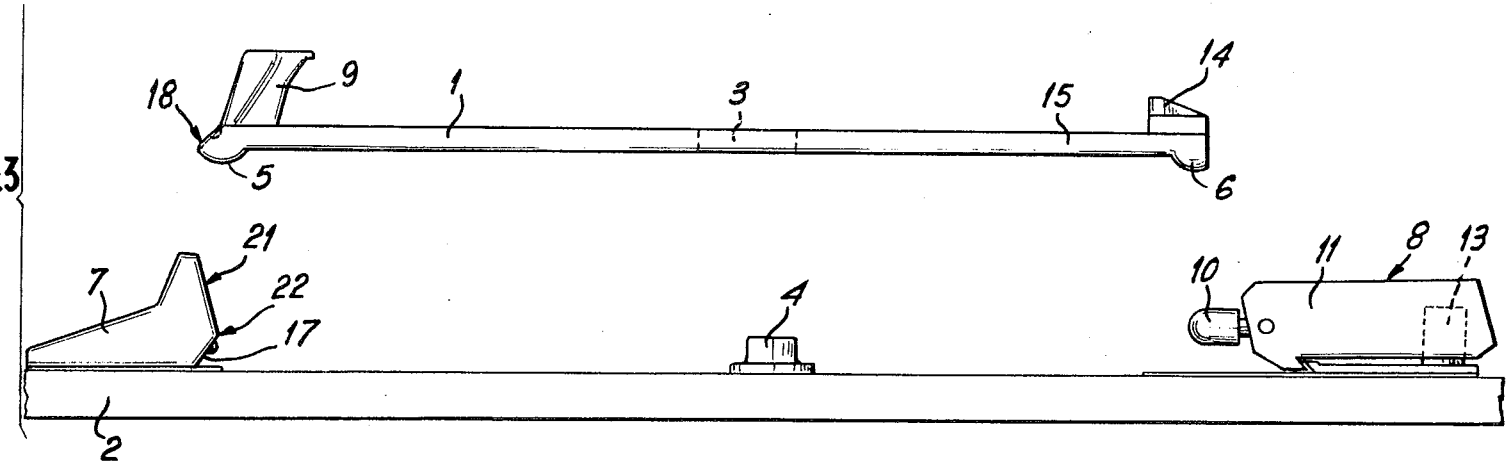
FIG. 3 is a side elevational view showing the movable plate of this ski binding before its locking or resetting engagement with the ski.
Figure 7:
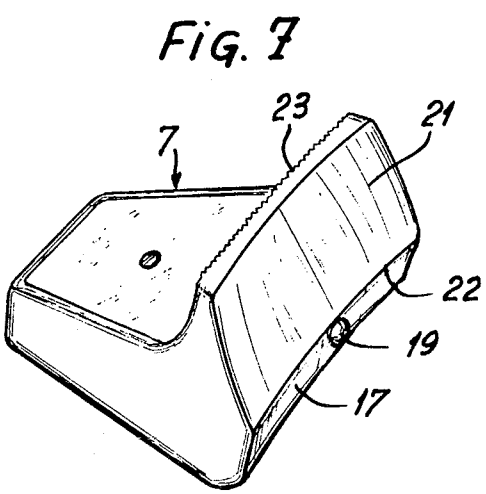
FIG. 7 is a perspective view of the front or toe-end abutment member of the safety ski binding of this invention.

Overlying the retaining face 17 is another inclined face 21 directed upwardly and forwardly, i.e. with an inclination opposite to that of face 17. In fact, this other inclined face 21 constitutes an engagement face adapted to facilitate the resetting of the front bearing face 18 of plate 1 under the retaining face 17 of abutment member 7. The two inclined faces 17 and 21 are separated by a common edge 22 (see FIGS. 3 and 7).

According to another essential feature characterizing this invention, the retaining face 17 and the engagement face 21 of abutment member 7 have a concave curvature of cylindrical profile. The bearing face 18 at the front end of plate 1 has likewise a cylindrical convexity of same radius of curvature as said concavity of face 17. The radius of these various curvatures is inferior to the length of plate 1 and at least as long as the difference between the front end of this plate and the center of pivot member 4. Thus, in the example illustrated, the radius of curvature $R_1$ (FIG. 5) of the engagement face 21 of said abutment member 21 is concentric with the pivot member 4, and the radius of curvature $R_2$ of bearing face 18 of the toe end of said plate is centered at O, which is the center of pivot member 4 when the movable plate is in its normal or operative position (as shown in FIG. 1).

As will be explained presently, the curvatures thus contemplated for the various co-operating faces of abutment member 7 and of the toe end of movable plate 1 are adapted to restore the latter automatically during its engagement, when the plate 1 is not presented in perfect alignment with the longitudinal center line of the ski. All the various features of the present safety ski binding are directed to facilitate the resetting of the movable plate 1 on the ski.

Figure 4:
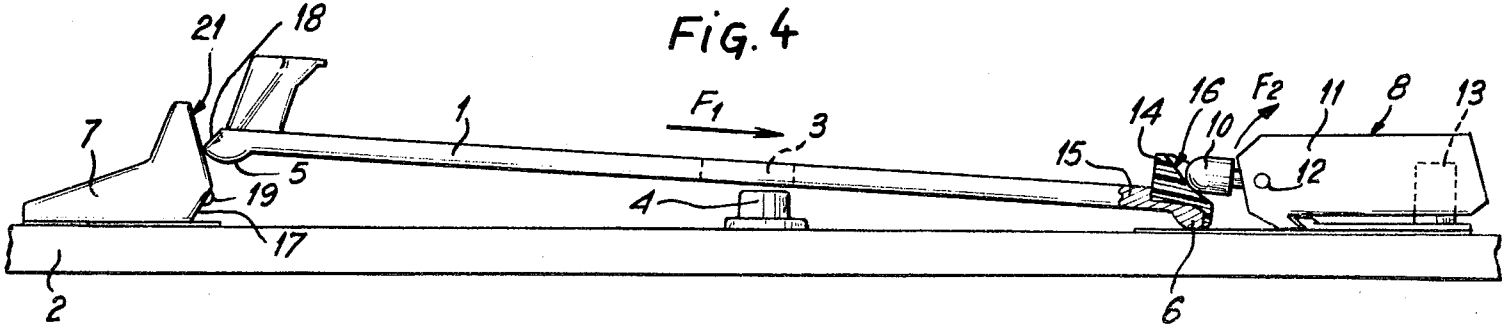
FIG. 4 is a similar view illustrating the first step of this resetting operation.

This resetting operation is performed by presenting the plate 1 in substantially the position illustrated in FIG. 4, so as to engage the slideway 14 of its heel end 15 under the spring-loaded lock bolt 10 of the rear retaining device. The front end of this plate 1 will then engage the engagement or re-insertion face 21 of abutment member 7 whereby the above-defined inclination will considerably facilitate the final snap engagement of the movable plate to its operative position. Finally, a pressure is exerted on the toe end of plate 1 whereby, due to the aforesaid inclination of the engagement face 21, this plate 1 will recede somewhat in the direction of the arrow $F_1$ (see FIG. 4). The inclined bottom 16 of slideway 14 will thus slide under the end of lock bolt 10 and cause a slight upward tilting of this lock bolt in the direction of the arrow $F_2$, i.e. by pivoting same about the pivot pin 12.

The upward pivotal movement of lock bolt 10 will thus permit a backward movement of plate 1 which is sufficient for enabling the front bearing face 18 to clear the edge 22 and eventually engage the lower retaining face 17.

More particularly, after clearing this edge 22 the plate 1 is pushed forwards by the resilient lock bolt 10 acting against the inclined bottom 16 of slideway 14. In fact, due to the action exerted by the resilient mechanism of the rear retaining device, this lock bolt 10 tends to resume its normal lower position illustrated in FIGS. 2 and 3. Therefore, the plate 1 is slightly urged forwards until its bearing face 18 engages the lower retaining face 17 of the fixed abutment member 7.

It will readily occur to those conversant with the art that the presence of the engagement face 21 will considerably facilitate the snap engagement of the front end of plate 1 against the backed-off retaining face 17. However, the specific profiles and curvatures contemplated for the co-operating faces of this abutment member 7 and of the front end of plate 1 ensure a reliable and firm snap engagement of this plate, even if the latter is not presented in a position of perfect alignment with the longitudinal center line of the ski.

Figure 5:
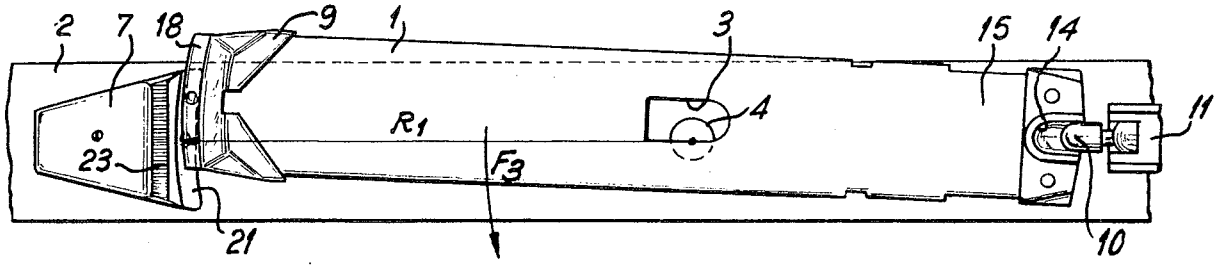
FIG. 5 is a plan view from above illustrating a faulty presentation of the movable plate during a resetting operation.
Figure 6:
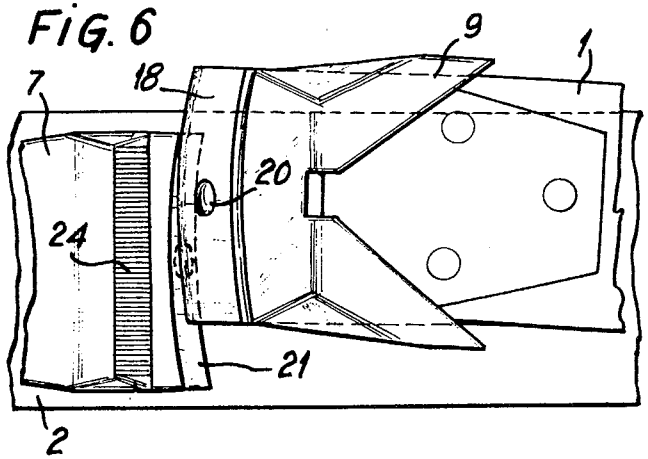
FIG. 6 is a fragmentary plan view from above showing on a different scale this faulty presentation.
Figure 8:
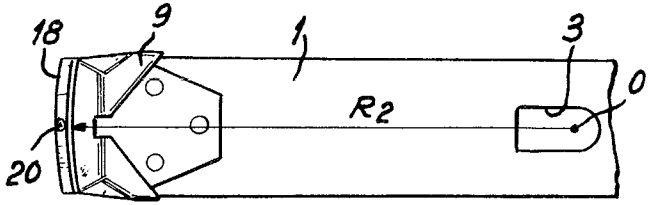
FIG. 8 is a fragmentary plan view from above of the movable plate of this ski binding.

In fact, if the plate 1 is presented somewhat askew, as illustrated in FIGS. 5 and 6, so that its longitudinal center line is not coincident with that of the underlying ski and its aperture 3 does not register with the pivot member 4, nevertheless the mere exerting of a downward pressure on the toe end of plate 1 will bring this plate in proper alignment with the ski.

In this case, the curved contact faces, i.e. the convex face 18 at the front end of plate 1 and the concave engagement face 21 of abutment member 7, tend to coincide with each other by causing the plate 1 to pivot in the direction of the arrow $F_3$ about the fulcrum formed by the front end of the rear lock bolt 10. Therefore, the downward sliding movement of the front end of plate 1 bearing against the engagement face 21 is attended by a pivotal movement of this plate in the direction of said arrow $F_3$ until the two curved faces 18 and 21 engage each other, i.e. until the longitudinal center line of the plate is aligned or parallel with the longitudinal center line of the ski. Thus, the movable plate 1 is automatically centered in the proper position and its aperture 3 registers with the fixed pivot member 4.

Thus, the plate can be snapped in position even when it is presented in a wrong position. This feature is extremely advantageous, considering the difficulty of presenting the plate in exact alignment with the ski when it is desired to set or reset the plate under field conditions.

Another advantage is due to the fact that the safety ski binding according to this invention prevents any faulty resetting of the plate which might cause a subsequent untimely release thereof. In fact, in the present case the plate setting or resetting can only take place in a definitely perfect manner.

Even the presence of snow adhering to the top surface of the ski cannot impair the proper locking of the plate in its operative position. The initial backward movement accomplished by this plate in the direction of the arrow $F_1$, as illustrated in FIG. 4, tends to wipe away any snow adhering at the rear end, so as to free the bearing area of the rib 6 of plate 1. Likewise, the subsequent forward movement of plate 1 will wipe away the snow adhering to the ski and thus clear the area necessary for the corresponding bearing rib 5 of the plate. As to the snow covering the ski beneath the plate, part of it is driven out by the plate itself during the plate setting or resetting movements. However, some snow may be left in this area, under the plate, due to the provision of a gap *e* determined by the height of the end bearing ribs 5 and 6.

As already mentioned in the foregoing, the retaining face 17 of abutment member 7 comprises a central spring-loaded push member 19 adapted to exert a resilient pressure against a matching central cavity 20 formed in the registering bearing face 18 of the toe end of plate 1. Thus, the push member 19 is capable of taking up any play possibly developing between the movable plate 1 and the retaining means secured to the ski.

Preferably, the front abutment member 7 may be adapted for use as a scraper for removing any snow adhering to the ski under the movable plate 1. To this end, the front surface of this abutment member comprises a serrated upper edge 23 as well as corresponding ribs 24.

It will readily occur to those skilled in the art that this invention should not be construed as being strictly limited by the specific form of embodiment described hereinabove by way of illustration with reference to the accompanying drawings. Thus, the resilient retaining device 8 disposed at the rear end of plate 1 may differ considerably from the one contemplated herein, provided that the locking member of this device be capable of exerting a slight forward pressure against said plate after the rear slideway 14 thereof has been engaged under said locking member.

On the other hand, the arrangement of the front or toe-end fixed abutment member 7 and that of the resilient retaining member 8 could be inverted; in this case, the fixed abutment member 7 will be disposed at the rear and the retaining device 8 at the front.

Having thus described the invention, what is claimed is:

1. In a safety ski binding of the type in which an elongated plate is pivotally and disengageably mounted on a ski, binding means at the front and rear ends of said plate hold the corresponding ends of the ski boot thereto, resilient retaining means are mounted on said ski and register with one end of said plate to keep said plate in its normal operative position while permitting the movement of said plate away from the ski and a fixed abutment member is mounted on said ski registering with the other end of said plate to retain the latter on said ski, the improvement which comprises providing said abutment member with a pair of inclined faces having a common horizontal edge substantially transverse of and parallel to said ski, the upper of said faces being inclined upwardly and away from the adjacent end of said plate, and the lower of said faces being inclined downwardly and away from the adjacent end of said plate, both of said faces having a circular-shaped concave curvature, and in which said plate is of a length slightly greater than the distance between said horizontal edge of said abutment member and the operating end of said resilient retaining means, and is provided with a downwardly declining face with a circular shaped convexity at its said other end, the radius of curvature of all of said faces being smaller than the length of said plate and at least as long as the difference between the other end of said plate and the center of the pivot, whereby downward pressure upon said plate causes the same to move downwardly along the upper face of said abutment member and longitudinally against said resilient retaining means, over said horizontal edge, and thence inwardly against the lower face of said abutment member, and the curvature of said faces centers said plate on said ski.

2. Safety ski binding as set forth in claim 1, wherein said movable plate comprises at either end, on its bottom surface, a rounded rib adapted to act as a bearing element on the top surface of the ski while providing a certain gap between said surface and said movable plate.

3. Safety ski binding as set forth in claim 2, wherein said retaining face of said fixed abutment member comprises a spring-loaded member adapted to exert a pressure against the bearing face of the front end of said movable plate in order to take up any possible play.

4. Safety ski binding as set forth in claim 3, wherein said fixed abutment member comprises a serrated upper edge adapted to act as a scraper for removing any snow adhering to the ski under said movable plate or under the ski boot.

* * * * *